US008641179B2

(12) United States Patent
Kuribayashi et al.

(10) Patent No.: US 8,641,179 B2
(45) Date of Patent: Feb. 4, 2014

(54) INK JET RECORDING APPARATUS

(75) Inventors: Yasushi Kuribayashi, Shizuoka-ken (JP); Kazuhiro Hara, Shizuoka-ken (JP); Satoshi Kaiho, Kanagawa-ken (JP); Hiroshi Murata, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 331 days.

(21) Appl. No.: 13/103,351

(22) Filed: May 9, 2011

(65) Prior Publication Data

US 2011/0279495 A1 Nov. 17, 2011

Related U.S. Application Data

(60) Provisional application No. 61/333,362, filed on May 11, 2010.

(51) Int. Cl.
*B41J 2/18* (2006.01)

(52) U.S. Cl.
USPC ..... 347/89; 347/9; 347/19

(58) Field of Classification Search
USPC ..... 347/7, 85, 89, 5, 9, 19
See application file for complete search history.

(56) References Cited

U.S. PATENT DOCUMENTS

| | | | | |
|---|---|---|---|---|
| 2007/0252860 | A1 | 11/2007 | Nitta et al. | |
| 2008/0151014 | A1 | 6/2008 | Matsuda | |
| 2008/0158320 | A1 * | 7/2008 | Nitta et al. | 347/89 |
| 2009/0051722 | A1 | 2/2009 | Kaiho | |
| 2011/0007105 | A1 | 1/2011 | Kuribayashi et al. | |
| 2011/0148997 | A1 | 6/2011 | Kuribayashi et al. | |
| 2011/0199418 | A1 | 8/2011 | Kaiho et al. | |

FOREIGN PATENT DOCUMENTS

| | | |
|---|---|---|
| JP | 2008-265097 | 11/2008 |

* cited by examiner

*Primary Examiner* — Lam S Nguyen
(74) *Attorney, Agent, or Firm* — Turocy & Watson, LLP

(57) ABSTRACT

According to one embodiment, an ink jet recording apparatus includes an ink jet head, a first tank arranged above the ink jet head and configured to store ink to be supplied to the ink jet head, a first tank valve that opens and closes in order to switch the inside of the first tank to be opened to or shut off from the atmosphere, a second tank arranged below the ink jet head and configured to store the ink collected from the ink jet head, a second tank valve that opens and closes in order to switch the inside of the second tank to be opened to or shut off from the atmosphere, a pipe configured to connect the ink jet head, the first tank, and the second tank and form a part of a circulation shape, a pump provided in the pipe between the first tank and the second tank, a passive pressure adjusting device connected to the second tank, arranged below the first tank, and configured to generate negative pressure using the gravity, and a third tank valve provided between the second tank and the passive pressure adjusting device.

15 Claims, 11 Drawing Sheets

INK JET RECORDING APPARATUS

CROSS-REFERENCE TO RELATED APPLICATIONS

This application is based upon and claims the benefit of priority from Provisional Application No. 61/333,362, filed on May 11, 2010, the entire contents of which are incorporated herein by reference.

FIELD

Embodiments described herein relate generally to an ink jet recording apparatus that circulates ink in an ink jet head.

BACKGROUND

In the past, in order to remove air bubbles and foreign matters from the periphery of an ink ejection port of an ink jet head, there is an ink jet recording apparatus that circulates ink in the ink jet head. In such an ink jet recording apparatus, the ejection of the ink from the ink jet head is unstable unless the pressure near a nozzle is kept at a proper value. As a result, the quality of an image printed on a sheet is deteriorated, for example, density unevenness occurs.

In order to circulate the ink in the ink jet head while keeping the pressure near the nozzle at the proper value, the ink jet recording apparatus has a configuration explained below. As an example, a tank configured to store the ink to be supplied to the ink jet head includes a mechanism in which a weight is hung from bellows. The capacity of the internal space of the tank is variable according to the operation of the bellows. Therefore, the tank having the bellows passively suppresses fluctuation in pressure generated in the internal space. As another example, the ink jet recording apparatus can include a mechanism configured to actively control the pressure near the nozzle to the proper value.

However, in the configuration explained above, the flow rate of the ink circulating in the ink jet head depends on the weight applied to the bellows. Therefore, the flow rate of the ink cannot be changed. Consequently, if foreign matters that cannot be completely flushed down at a normal flow rate are caught in the ink jet head, the foreign matters cannot be removed.

DETAILED DESCRIPTION

In general, according to one embodiment, an ink jet recording apparatus includes: an ink jet head; a first tank arranged above the ink jet head and configured to store ink to be supplied to the ink jet head; a first tank valve that opens and closes in order to switch the inside of the first tank to be opened to or shut off from the atmosphere; a second tank arranged below the ink jet head and configured to store the ink collected from the ink jet head; a second tank valve that opens and closes in order to switch the inside of the second tank to be opened to or shut off from the atmosphere; a pipe configured to connect the ink jet head, the first tank, and the second tank and form a part of a circulation shape; a pump provided in the pipe between the first tank and the second tank; a passive pressure adjusting device connected to the second tank, arranged below the first tank, and configured to generate negative pressure using the gravity; and a third tank valve provided between the second tank and the passive pressure adjusting device.

Figure 1:
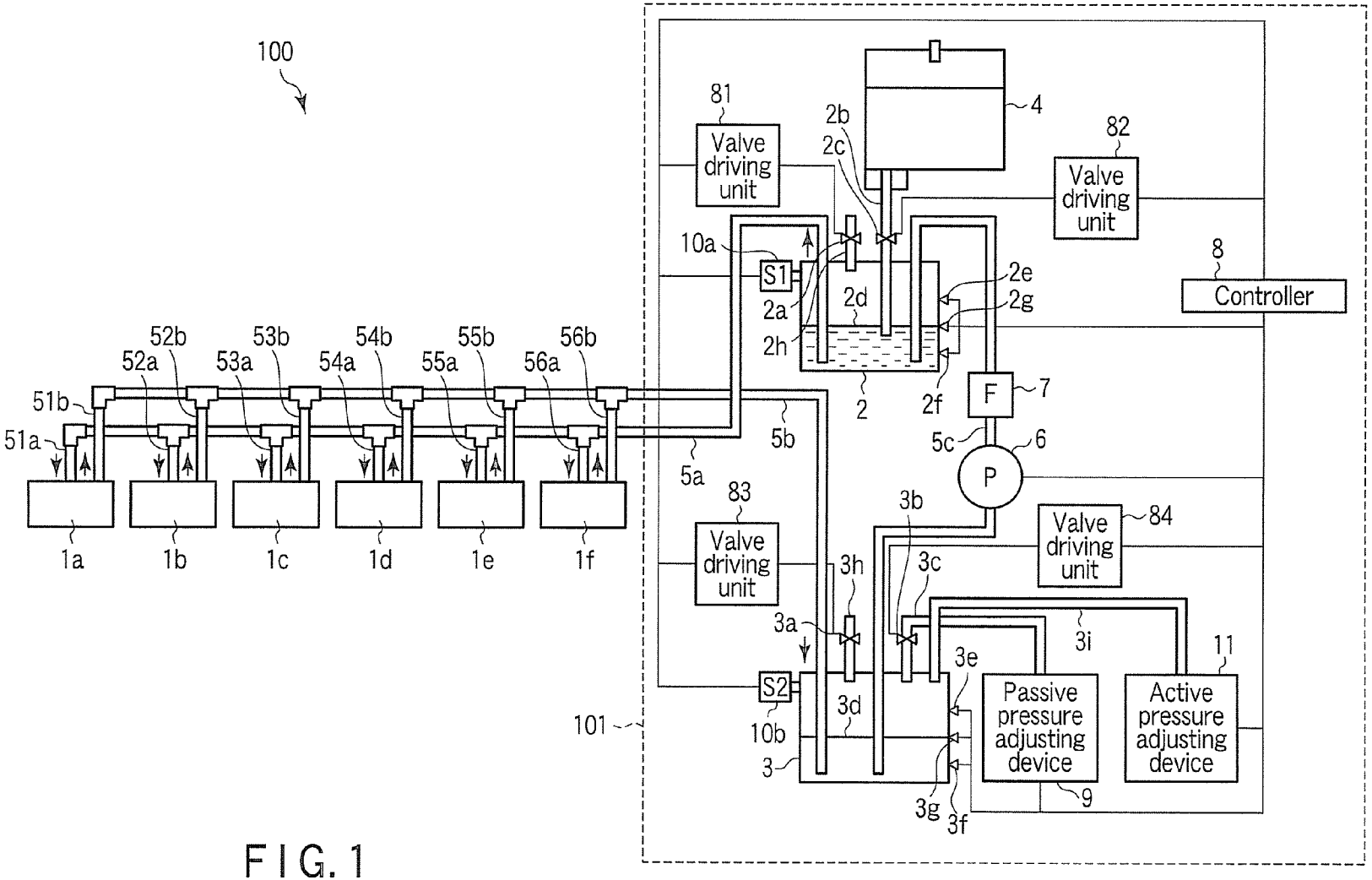
FIG. 1 is an exemplary schematic diagram for explaining an ink jet recording apparatus according to a first embodiment.

Embodiments are explained below with reference to the accompanying drawings. FIG. 1 is a diagram for schematically explaining an ink jet recording apparatus 100 according to a first embodiment. The ink jet recording apparatus 100 includes an ink jet head 1, a first ink tank 2, a second ink tank 3, a main tank 4, a pipe 5 configured to connect the ink jet head 1, the first ink tank 2, the second ink tank 3, and the main ink tank 4 and form circulation, a pump 6, a filter 7, a controller 8, a passive pressure adjusting device 9, and an active pressure adjusting device 11. The first ink tank 2, the second ink tank 3, the main tank 4, the pipe 5, the pump 6, the filter 7, the controller 8, the passive pressure adjusting device 9, the active pressure adjusting device 11, and the like are devices and members included in an ink tank device 101 as well.

The ink jet head 1 includes plural (in FIG. 1, six) ink jet heads 1*a*, 1*b*, 1*c*, 1*d*, 1*e*, and 1*f*. The configuration of the ink jet heads 1*a* to 1*f* is explained below. The ink jet heads 1*a* to 1*f* are arranged at the same height and substantially horizontally. The ink jet heads 1*a* to 1*f* are ink jet heads of an ink circulation type.

The configuration of the ink tank device 101 is explained below. The pipe 5 includes a common supply pipe 5*a* configured to connect the first ink tank 2 and the ink jet head 1, a common collection pipe 5*b* configured to connect the ink jet head 1 and the second ink tank 3, and a connection pipe 5*c* configured to connect the first tank 2 and the second tank 3. The pump 6 is arranged in the connection pipe 5*c*. A circulation shape is formed by connecting the first ink tank 2, the ink jet head 1, the common supply pipe 5*a*, the second tank 3, the common collection pipe 5*b*, and the connection pipe 5*c*. The first ink tank 2 is arranged further on the upstream side than the second ink tank 3 with reference to the pump 6.

The configuration of the first tank 2 is explained below. The first tank 2 is provided above a nozzle surface of the ink jet head 1. The first tank 2 includes a pipe 2*b* configured to connect the main tank 4. A valve 2*c* is provided halfway in the pipe 2*b*. Liquid level sensors 2*e*, 2*g*, and 2*f* are respectively provided in predetermined positions in order of height from the bottom surface. The inside of the first tank 2 communicate with the atmosphere via a pipe 2*h*. A valve 2*a* (a first tank valve) is provided halfway in the pipe 2*h*. The first tank 2 includes a first pressure sensor 10*a*. Ink before circulating the inside of the ink jet heads 1*a* to 1*f* is stored via the common supply pipe 5*a*. In other words, the first tank 2 stores the ink to be supplied to the inside of the ink jet heads 1*a* to 1*f*. The first tank 2 is a sealed container. The first tank 2 is located in a position higher than nozzle surfaces of the ink jet heads 1*a* to 1*f*. The liquid level sensors 2*e*, 2*g*, and 2*f* detect a position where the liquid level of the ink reaches. The valve 2*a* is capable of opening and closing in order to switch the inside of the first tank 2 to be opened to and shut off from the atmosphere. The inside of the first tank 2 is opened to the atmosphere, if the valve 2*a* is open. The first pressure sensor 10*a* detects the pressure of an air layer on the inside of the first tank 2. The first pressure sensor 10*a* may be provided in the common supply pipe 5*a*. In this case, the first pressure sensor 10*a* detects the pressure of the ink flowing through the common supply pipe 5*a*.

The main tank (an ink cartridge) 4 stores the ink. The main tank 4 is opened to the atmospheric pressure. The valve 2*c* is capable of switching outflow and shutoff of the ink from the main tank 4 to the first tank 2 by opening and closing. The ink in the main tank 4 flows out to the first tank 2, if the valve 2*c* is open.

The configuration of the second tank 3 is explained below. The second tank 3 is a sealed container arranged in a position lower than the first tank 2 and arranged in a position lower than the nozzle surfaces of the ink jet heads 1*a* to 1*f*. In the second tank 3, liquid level sensors 3*e*, 3*g*, and 3*f* are respectively provided in predetermined positions in order of height from the bottom surface. The inside of the second tank 3 has a pipe 3*h* that communicates with the atmosphere. A valve 3*a* (a second tank valve) is provided halfway in the pipe 3*h*. The second tank 3 includes a second pressure sensor 10*b*. The second tank 3 stores the ink after circulating through the ink jet heads 1*a* to 1*f*. In other words, the second tank 3 stores the ink collected from the ink jet heads 1*a* to 1*f*. The liquid level sensors 3*e*, 3*g*, and 3*f* detect a position where the liquid level of the ink reaches. The valve 3*a* is capable of opening and closing in order to switch the inside of the second tank 3 to be opened to or shut off from the atmosphere. The inside of the second tank 3 is opened to the atmosphere, if the valve 3*a* is open. The second pressure sensor 10*b* detects the pressure of an air layer on the inside of the second tank 3. The second pressure sensor 10*b* may be provided in the common collection pipe 5*b*. In this case, the second pressure sensor 10*b* detects the pressure of the ink flowing through the common collection pipe 5*b*.

Figure 2:
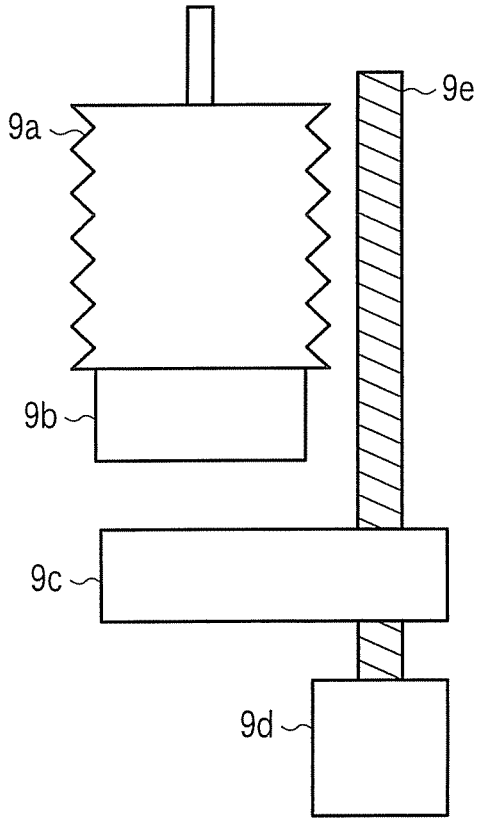
FIG. 2 is an exemplary diagram of the configuration of a passive pressure adjusting device in the first embodiment.

The passive pressure adjusting device 9 is explained below. The passive pressure adjusting device 9 generates negative pressure using the gravity. The passive pressure adjusting device 9 is connected to the second tank 3 via the pipe 3*c*. FIG. 2 is a diagram of the configuration of the passive pressure adjusting device 9. The passive pressure adjusting device 9 includes bellows 9*a*, a weight 9*b*, a moving table 9*c*, and a motor 9*d*. The bellows 9*a* have the weight 9*b* in a lower part thereof. The moving table 9*c* is moved up and down in the vertical direction by the motor 9*d* via a shaft 9*e*. The bellows 9*a* are compressed, if the moving table 9*c* lifts the weight 9*b* according to the driving of the motor 9*d*. The weight 9*b* falls with the own weight, if the moving table 9*c* moves faster than the fall by own weight of the weight 9*b* according to the driving of the motor 9*d* in a state in which the bellows 9*a* are compressed. If the weight 9*b* falls with the own weight, the passive pressure adjusting device 9 starts adjustment of the pressure on the inside of the second tank 3.

The pipe 3*c* includes a valve 3*b* (a third tank valve). The valve 3*b* is capable of switching presence or absence of pressure adjustment on the inside of the second tank 3 by the passive pressure adjusting device 9 by opening and closing. If the valve 3*b* is open, the pressure on the inside of the second tank 3 is adjusted by the passive pressure adjusting device 9.

The active pressure adjusting device 11 is explained below. The active pressure adjusting device 11 is connected to the second tank 3 via a pipe 3*i*. The active pressure adjusting device 11 actively adjusts the pressure on the inside of the second tank 3. The active pressure adjusting device 11 is, for example, a pump configured to increase or reduce the air on the inside of the second tank 3.

In the ink tank device 101, the pipe 5*c* includes the pump (an ink moving mechanism) 6 and the filter 7. The pump 6 moves the ink in a direction from the second tank 3 to the first tank 2. The filter 7 removes foreign matters included in the ink flowing through the pipe 5*b*.

The configuration of the common supply pipe 5*a* is explained in detail below. The common supply pipe 5*a* includes head supply pipes 51*a* to 56*a* at fixed intervals along the longitudinal direction thereof. The head supply pipes 51*a* to 56*a* are respectively connected to supply ports of the ink jet heads 1*a* to 1*f*. The ink on the inside of the common supply pipe 5*a* branches and flows to the head supply pipes 51*a* to 56*a* and then flows to the ink jet heads 1*a* to 1*f*.

The configuration of the common collection pipe 5*b* is explained below. In the common collection pipe 5*b*, head collection pipes 51*b* to 56*b* are provided at fixed intervals along the longitudinal direction thereof. The head collection pipes 51*b* to 56*b* are respectively connected to collection ports of the ink jet heads 1*a* to 1*f*. The ink on the inside of the ink jet heads 1*a* to 1*f* flows to the common collection pipe 5*b* via the head collection pipes 51*b* to 56*b*.

In the ink jet recording apparatus 100, the position of the first tank 2, the position of the second tank 3, a spring constant of the bellows 9*a* included in the passive pressure adjusting device 9, and the weight of the weight 9*b* can be set such that the pressure near the nozzles of the ink jet heads 1*a* to 1*f* is adjusted to a value optimum for printing. As another example, the positions, the spring constant, and the weight can be set such that a flow rate is adjusted to a value that is necessary for removing air bubbles and foreign matters from the periphery of ejection ports of the ink jet heads 1*a* to 1*f* and does not affect the printing by the ink jet heads 1*a* to 1*f*.

A control system for the ink jet recording apparatus 100 is explained below. The ink jet recording apparatus 100 includes a controller 8 and valve driving units 81 to 84. The controller 8 controls the operation of the units of the ink jet recording apparatus 100. For example, the controller 8 acquires detection information from the liquid level sensors 2*e* to 2*g*, the liquid level sensors 3*e* to 3*g*, the first pressure sensor 10*a*, and the second pressure sensor 10*b*. The controller 8 controls the operation of the pump 6. The controller 8 controls the valve driving units 81 to 84. The valve driving unit 81 switches opening and closing of the valve 2*a*. The valve driving unit 82 switches opening and closing of the valve 2*c*. The valve driving unit 83 switches opening and closing of the valve 3*a*. The valve driving unit 84 switches opening and closing of the valve 3*b*. The controller 8 performs control of the compression of the passive pressure adjusting device 9, control of the fall by own weight, and control of the active pressure adjusting device 11.

Figure 3:
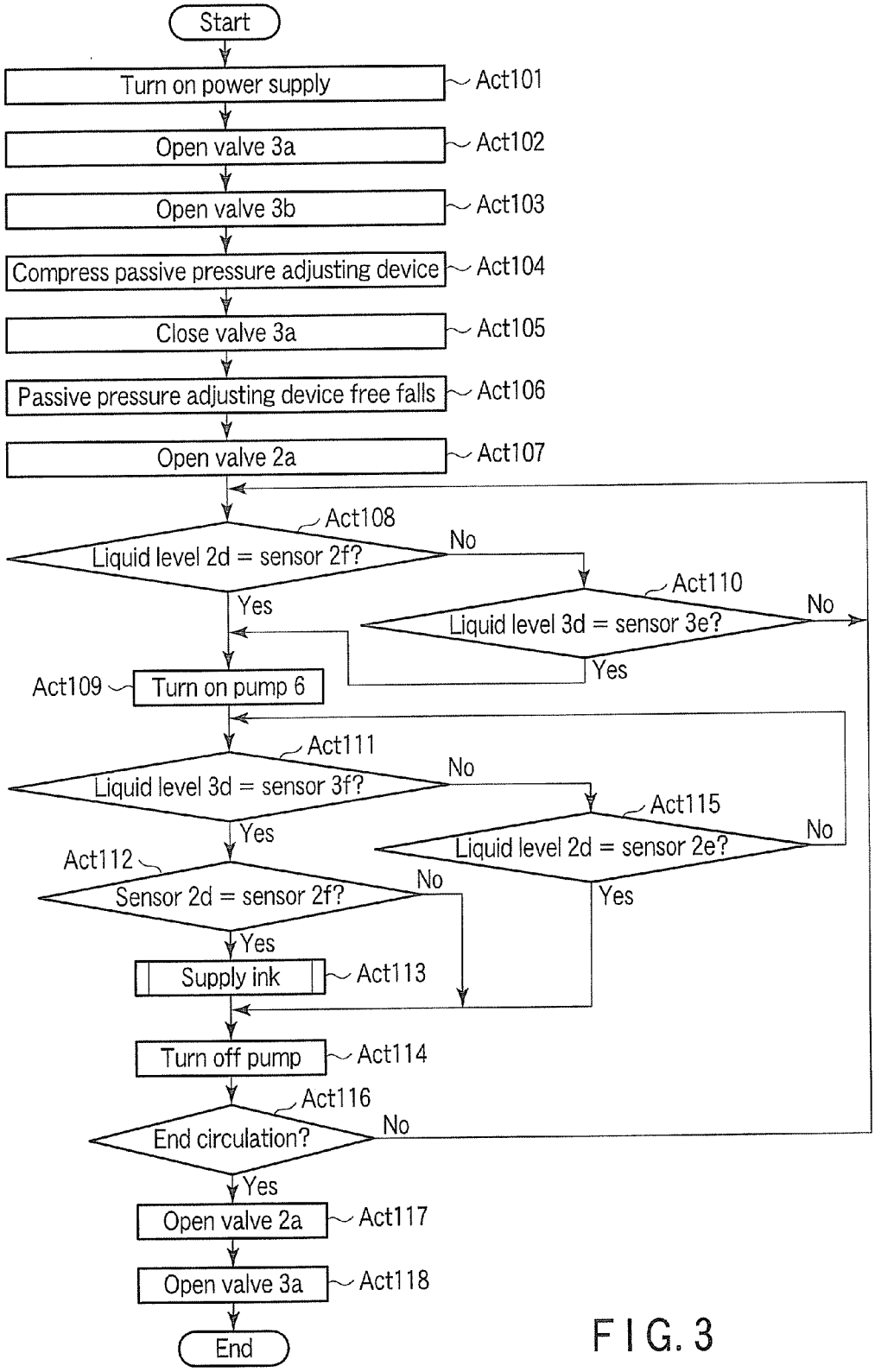
FIG. 3 is an exemplary flowchart for explaining normal circulation control for ink in the first embodiment.

Normal circulation control (first circulation control) of the ink in the ink jet recording apparatus 100 is explained below. The normal circulation control means control for circulating, under the control by the controller 8, the ink stored by the first tank 2 to the first tank 2 via the common supply pipe 5*a*, the ink jet heads 1*a* to 1*f*, the common collection pipe 5*b*, and the second tank 3 during the printing operation by the ink jet heads 1*a* to 1*f*. FIG. 3 is a flowchart for explaining the normal circulation control for the ink in the ink jet recording apparatus 100 according to the first embodiment.

The controller 8 turns on a power supply on the basis of an input (e.g., a printing instruction) by a user (Act 101). The controller 8 performs control to open the valve 3*a* (Act 102). The controller 8 performs control to close the valve 3*b* (Act 103). The controller 8 performs control to compress the bellows 9*a* of the passive pressure adjusting device 9 (Act 104). The controller 8 performs control to close the valve 3*a* (Act 105). The controller 8 performs control to cause the weight 9*b* of the passive pressure adjusting device 9 to free fall (Act 106). The controller 8 performs control to open the valve 2*a* (Act 107). The controller 8 determines whether a liquid level 2*d* of the first tank 2 is in the position of the liquid level sensor 2*f* (Act 108). If the liquid level 2*d* of the first tank 2 is in the position of the liquid level sensor 2*f* (Yes in Act 108), the controller 8 performs control to turn on (start) the operation of the pump 6 (Act 109). If the liquid level 2*d* of the first tank 2 is not in the position of the liquid level sensor 2*f* (No in Act 108), the controller 8 determines whether a liquid level 3*d* of the second tank 3 is in the position of the liquid level sensor 3*e* (Act 110).

If the liquid level 3*d* of the second tank 3 is not in the position of the liquid level sensor 3*e* (No in Act 110), the controller 8 returns to Act 108 and performs control. If the liquid level 3*d* of the second tank 3 is in the position of the liquid level sensor 3*e* (Yes in Act 110), in Act 109, the controller 8 performs control to turn on the operation of the pump 6.

The controller 8 determines whether the liquid level 3*d* of the second tank 3 is in the position of the liquid level sensor 3*f* (Act 111). If the liquid level 3*d* of the second tank 3 is in the position of the liquid level sensor 3*f* (Yes in Act 111), the controller 8 determines whether the liquid level 2*d* of the first tank 2 is in the position of the liquid level sensor 2*f* (Act 112). If the liquid level 2*d* of the first tank 2 is in the position of the liquid level sensor 2*f* (Yes in Act 112), the controller 8 performs control to supply the ink stored by the main tank 4 to the first tank 2 (Act 113). Thereafter, the controller 8 performs control to turn off (stop) the operation of the pump 6 (Act 114). If the liquid level 2*d* of the first tank 2 is not in the position of the liquid level sensor 2*f* (No in Act 112), in Act 114, the controller 8 performs control to turn off the operation of the pump 6.

If the liquid level 3*d* of the second tank 3 is not in the position of the liquid level sensor 3*f* (No in Act 111), the controller 8 determines whether the liquid level 2*d* of the first tank 2 is in the position of the liquid level sensor 2*e* (Act 115). If the liquid level 2*d* of the first tank 2 is not in the position of the liquid level sensor 2*e* (No in Act 115), the controller 8 returns to Act 111 and performs control. If the liquid level 2*d* of the first tank 2 is in the position of the liquid level sensor 2*e* (Yes in Act 115), in Act 114, the controller 8 performs control to turn off the operation of the pump 6.

After turning off the operation of the pump 6 in Act 115, the controller 8 determines whether to end the normal circulation control for the ink (Act 116). The controller 8 determines the end of the normal circulation control, for example, on the basis of whether the printing operation by the ink jet heads 1*a* to 1*f* ends. If the controller 8 determines not to end the normal circulation control for the ink (No in Act 116), the controller 8 returns to Act 108 and performs control. If the controller 8 determines to end the normal circulation control for the ink (Yes in Act 116), the controller 8 performs control to close the valve 2*a* (Act 117). The controller 8 performs control to open the valve 3*a* (Act 118).

According to the control by the controller 8 shown in FIG. 3, since the valve 3*b* is open during the normal circulation control, negative pressure is applied to the second tank 3 by the passive pressure adjusting device 9. Therefore, the ink stored by the first tank 2 moves in order through the common supply pipe 5*a*, the ink jet heads 1*a* to 1*f*, the common collection pipe 5*b*, and the second tank 3. The ink stored by the second tank 3 is moved to the first tank 2 by the pump 6 via the pipe 5*c*. In this way, the ink stored by the first tank 2 circulates on the inside of the ink jet recording apparatus 100.

Figure 4:
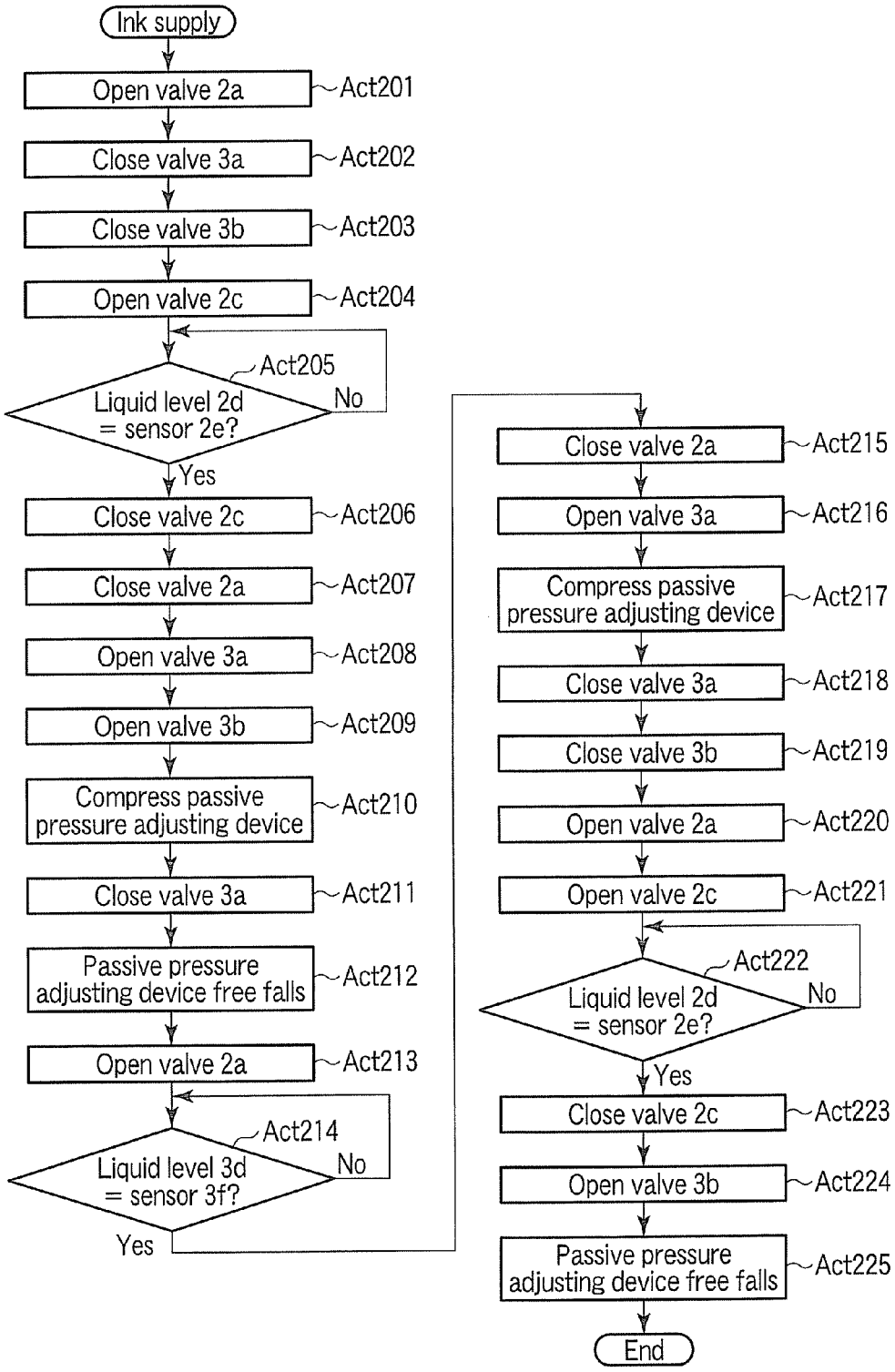
FIG. 4 is an exemplary flowchart for explaining operation for supplying the ink in the first embodiment.

FIG. 4 is a flowchart for explaining operation for supplying the ink from the main tank 4 to the first tank 2 in Act 110 in FIG. 3. First, the controller 8 performs control to open the valve 2*a* (Act 201). The controller 8 performs control to close the valve 3*a* (Act 202). The controller 8 performs control to close the valve 3*b* (Act 203). The controller 8 performs control to open the valve 2*c* (Act 204).

Thereafter, the controller 8 determines whether the liquid level 2*d* of the first tank 2 is in the position of the liquid level sensor 2*e* (Act 205). If the liquid level 2*d* of the first tank 2 is not in the position of the liquid level sensor 2*e* (No in Act 205), the controller 8 stays on standby until the liquid level 2*d* of the first tank 2 reaches the position of the liquid level sensor 2*e*. If the liquid level 2*d* of the first tank 2 is in the position of the liquid level sensor 2*e* (Yes in Act 205), the controller 8 performs control to close the valve 2*c* (Act 206). The controller 8 performs control to close the valve 2*a* (Act 207). The controller 8 performs control to open the valve 3*a* (Act 208). The controller 8 performs control to open the valve 3*b* (Act 209).

Thereafter, the controller 8 performs control to compress the bellows 9*a* of the passive pressure adjusting device 9 (Act 210). In other words, the controller 8 performs control to shut off the operation of the passive pressure adjusting device 9. The controller 8 performs control to close the valve 3*a* (Act 211). The controller 8 performs control to cause the weight 9*b* of the passive pressure adjusting device 9 to free fall (Act 212). In other words, the controller 8 performs control to start the operation of the passive pressure adjusting device 9. The controller 8 performs control to open the valve 2*a* (Act 213).

Thereafter, the controller 8 determines whether the liquid level 3*d* of the second tank 3 is in the position of the liquid level sensor 3*f* (Act 214). If the liquid level 3*d* of the second take 3 is not in the position of the liquid level sensor 3*f* (No in Act 214), the controller 8 stays on standby until the liquid level 3*d* of the second tank 3 reaches the position of the liquid level sensor 3*f*. If the liquid level 3*d* of the second tank 3 is in the position of the liquid level sensor 3*f* (Yes in Act 214), the controller 8 performs control to close the valve 2*a* (Act 215). The controller 8 performs control to open the valve 3*a* (Act 216).

Thereafter, the controller 8 performs control to compress the bellows 9*a* of the passive pressure adjusting device 9 (Act 217). The controller 8 performs control to close the valve 3*a* (Act 218). The controller 8 performs control to close the valve 3*b* (Act 219). The controller 8 performs control to open the valve 2*a* (Act 220). The controller 8 performs control to open the valve 2*c* (Act 221).

Thereafter, the controller 8 determines whether the liquid level 2*d* of the first tank 2 is in the position of the liquid level sensor 2*e* (Act 222). If the liquid level 2*d* of the first tank 2 is not in the position of the liquid level sensor 2*e* (No in Act 222), the controller 8 stays on standby until the liquid level 2*d* of the first tank 2 reaches the position of the liquid level sensor 2*e*. If the liquid level 2*d* of the first tank 2 is in the position of the liquid level sensor 2*e* (Yes in Act 222), the controller 8 performs control to close the valve 2*c* (Act 223). The controller 8 performs control to open the valve 3*b* (Act 224). The controller 8 performs control to cause the weight 9*b* of the passive pressure adjusting device 9 to free fall (Act 225).

Figure 5:
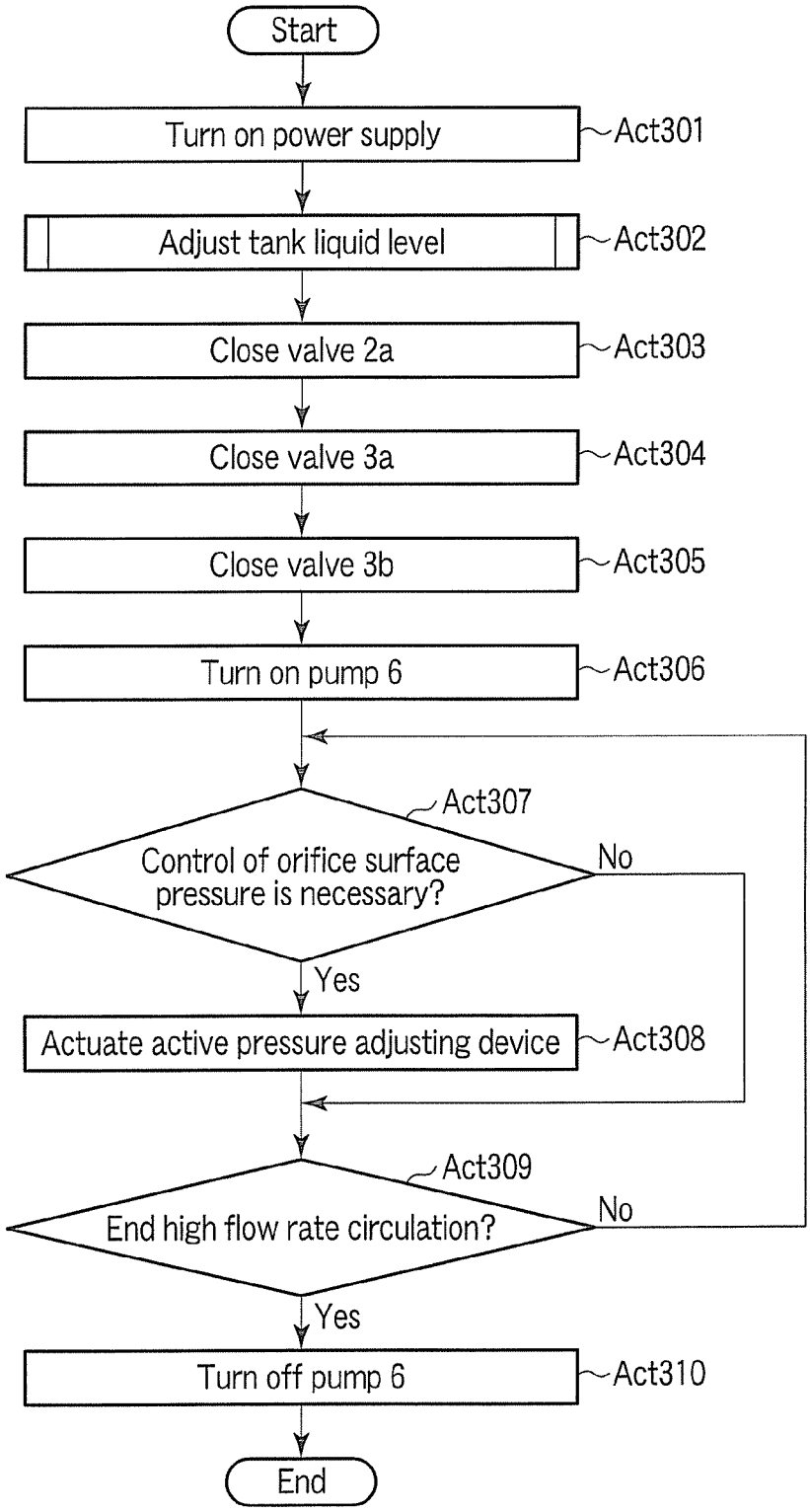
FIG. 5 is an exemplary flowchart for explaining high flow rate circulation control for the ink in the first embodiment.

High flow rate circulation control (second circulation control) for the ink in the ink jet recording apparatus 100 according to the first embodiment is explained below. The high flow rate circulation control means control for circulating, under the control by the controller 8, the ink stored by the first tank 2 to the first tank 2 at a flow rate higher than that in the normal circulation control via the common supply pipe 5*a*, the ink jet heads 1*a* to 1*f*, the common collection pipe 5*b*, and the second tank 3. FIG. 5 is a flowchart for explaining the high flow rate circulation control for the ink in the ink jet recording apparatus 100.

First, the controller 8 performs control to turn on the power supply on the basis of input of the high flow rate circulation control by the user (Act 301). The controller 8 performs control to adjust the position of the liquid level 2*d* of the first tank 2 and the position of the liquid level 3*d* of the second tank 3 (Act 302). In other words, the controller 8 performs control to adjust an amount of ink stored by the first tank 2 and an amount of ink stored by the second tank 3. Thereafter, the controller 8 performs control to close the valve 2*a* (Act 303). The controller 8 performs control to close the valve 3*a* (Act 304). The controller 8 performs control to close the valve 3*b* (Act 305). In other words, the controller 8 shuts off the influence of the passive pressure adjusting device 9 on the inside of the second tank 3. The controller 8 performs control to turn on the operation of the pump 6 (Act 306).

Thereafter, the controller 8 determines whether control of orifice surface pressure of the ink jet heads 1*a* to 1*f* is necessary (Act 307). As an example, the controller 8 calculates the pressure near the nozzles of the ink jet heads 1*a* to 1*f* on the basis of detection information from the first pressure sensor 10*a* and the second pressure sensor 10*b*. The controller 8 determines, on the basis of whether the pressure near the nozzles of the ink jet heads 1*a* to 1*f* is equal to or higher than a predetermined value, whether the control of the orifice surface pressure is necessary.

If the controller 8 determines that the control of the orifice surface pressure is necessary (Yes in Act 307), the controller 8 performs control to move the active pressure adjusting device 11 (Act 308). Thereafter, the controller 8 determines whether to end the high flow rate circulation control (Act 309). As an example, the controller 8 determines to end the high flow rate circulation control according to input of power-off by the user or elapse of a fixed time from power-on. If the controller 8 determines that the control of the orifice surface pressure is unnecessary (No in Act 307), in Act 309, the controller 8 determines whether to end the high flow rate circulation control. If the controller 8 determines not to end the high flow rate circulation control (No in Act 309), the controller 8 returns to Act 307 and performs control. If the controller 8 determines to end the high flow rate circulation control (Yes in Act 309), the controller 8 performs control to turn off (stop) the operation of the pump 6 (Act 310).

According to the control by the controller 8 shown in FIG. 5, during the high flow rate circulation control, since the valve 3*b* is closed, negative pressure is not applied to the second tank 3 by the passive pressure adjusting device 9. Therefore, the ink stored by the first tank 2 moves at a flow rate higher than that in the normal circulation control in order through the common supply pipe 5*a*, the ink jet heads 1*a* to 1*f*, the common collection pipe 5*b*, and the second tank 3.

Figure 6:
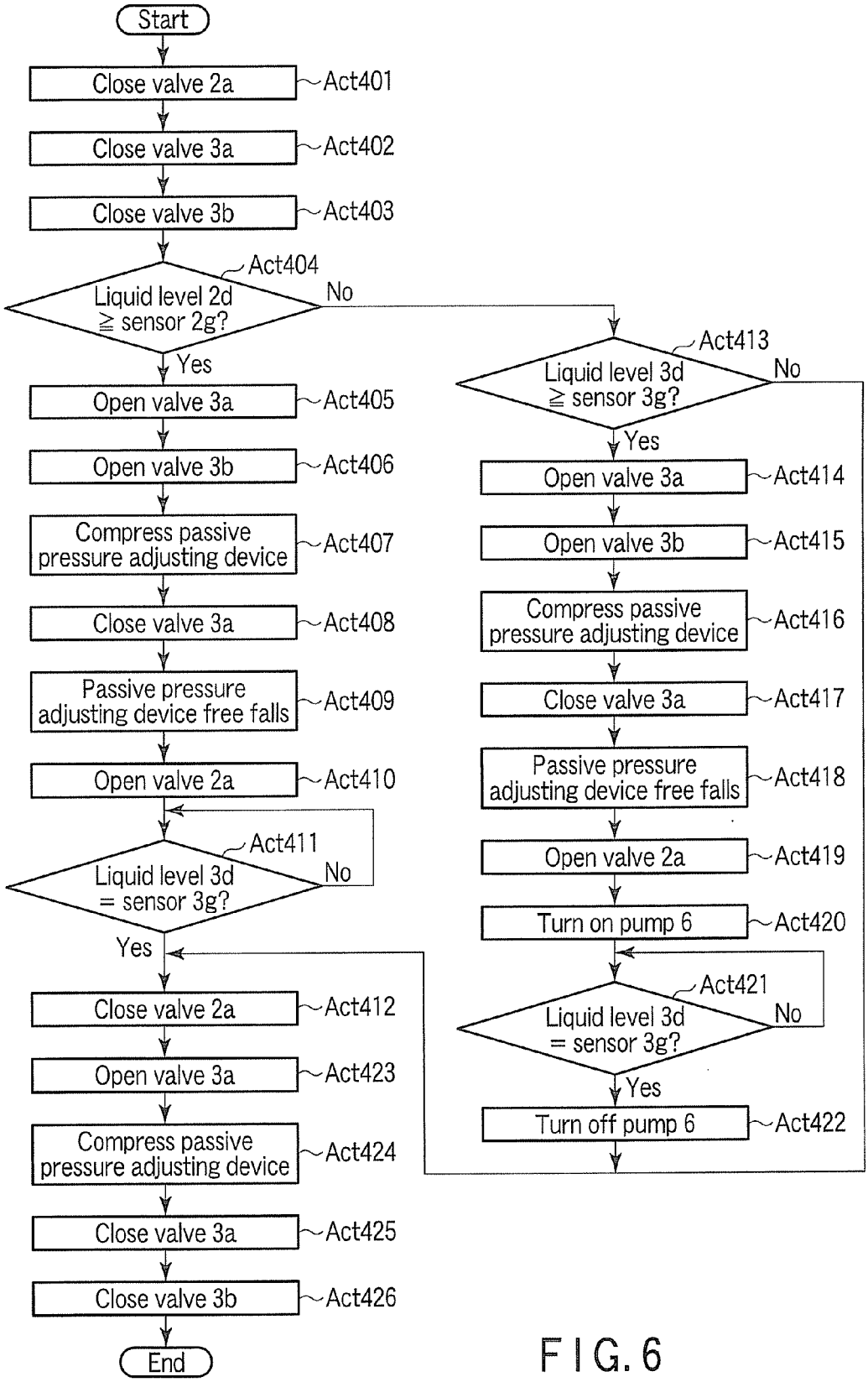
FIG. 6 is an exemplary flowchart for explaining liquid level adjustment in the first embodiment.

FIG. 6 is a flowchart for explaining the adjustment of the position of the liquid level 2*d* of the first tank 2 and the position of the liquid level 3*d* of the second tank 3 in Act 302 in FIG. 5. The controller 8 performs control to close the valve 2*a* (Act 401). The controller 8 performs control to close the valve 3*a* (Act 402). The controller 8 performs control to close the valve 3*b* (Act 403).

Thereafter, the controller 8 determines whether the liquid level 2*d* of the first tank 2 is equal to or higher than the position of the liquid level sensor 2*g* (Act 404). If the liquid level 2*d* of the first tank 2 is equal to or higher than the position of the liquid level sensor 2*g* (Yes in Act 404), the controller 8 performs control to open the valve 3*a* (Act 405). The controller 8 performs control to open the valve 3*b* (Act 406). The controller 8 performs control to compress the bellows 9*a* of the passive pressure adjusting device 9 (Act 407). The controller 8 performs control to close the valve 3*a* (Act 408). The controller 8 performs control to cause the weight 9*b* of the passive pressure adjusting device 9 to free fall (Act 409). The controller 8 performs control to open the valve 2*a* (Act 410). Thereafter, the controller 8 determines whether the liquid level 3*d* of the second tank 3 is in the position of the liquid level sensor 3*g* (Act 411). If the liquid level 3*d* of the second tank 3 is not in the position of the liquid level sensor 3*g* (No in Act 411), the controller 8 stays on standby until the liquid level 3*d* of the second tank 3 reaches the position of the liquid level sensor 3*g*. If the liquid level 3*d* of the second tank 3 is in the position of the liquid level sensor 3*g* (Yes in Act 411), the controller 8 performs control to close the valve 2*a* (Act 412).

If the liquid level 2*d* of the first tank 2 is not equal to or higher than the position of the liquid level sensor 2*g* (No in Act 404), the controller 8 determines whether the liquid level 3*d* of the second tank 3 is equal to or higher than the position of the liquid level sensor 3*g* (Act 413). If the liquid level 3*d* of the second tank 3 is equal to or higher than the position of the liquid level sensor 3*g* (Yes in Act 413), the controller 8 performs control to open the valve 3*a* (Act 414). The controller 8 performs control to open the valve 3*b* (Act 415). The controller 8 performs control to compress the bellows 9*a* of the passive pressure adjusting device 9 (Act 416). The controller 8 performs control to close the valve 3*a* (Act 417). The controller 8 performs control to cause the weight 9*b* of the passive pressure adjusting device 9 to free fall (Act 418). The controller 8 performs control to open the valve 2*a* (Act 419).

Thereafter, the controller 8 performs control to turn on the operation of the pump 6 (Act 420). The controller 8 determines whether the liquid level 3*d* of the second tank 3 is in the position of the liquid level sensor 3*g* (Act 421). If the liquid level 3*d* of the second tank 3 is not in the position of the liquid level sensor 3*g* (No in Act 421), the controller 8 stays on standby until the liquid level 3*d* of the second tank 3 reaches the position of the liquid level sensor 3*g*. If the liquid level 3*d* of the second tank 3 is in the position of the liquid level sensor 3*g* (Yes in Act 421), the controller 8 performs control to turn off the operation of the pump 6 (Act 422). Thereafter, in Act 412, the controller 8 performs control to close the valve 2*a*.

If the liquid level 3*d* of the second tank 3 is not equal to or higher than the liquid level sensor 3*g* (No in Act 413), in Act 412, the controller 8 performs control to close the valve 2*a*. After Act 412, the controller 8 performs control to open the valve 3*a* (Act 423). The controller 8 performs control to compress the bellows 9*a* of the passive pressure adjusting device 9 (Act 424). The controller 8 performs control to close the valve 3*a* (Act 417). The controller 8 performs control to close the valve 3*b* (Act 426).

Figure 7:
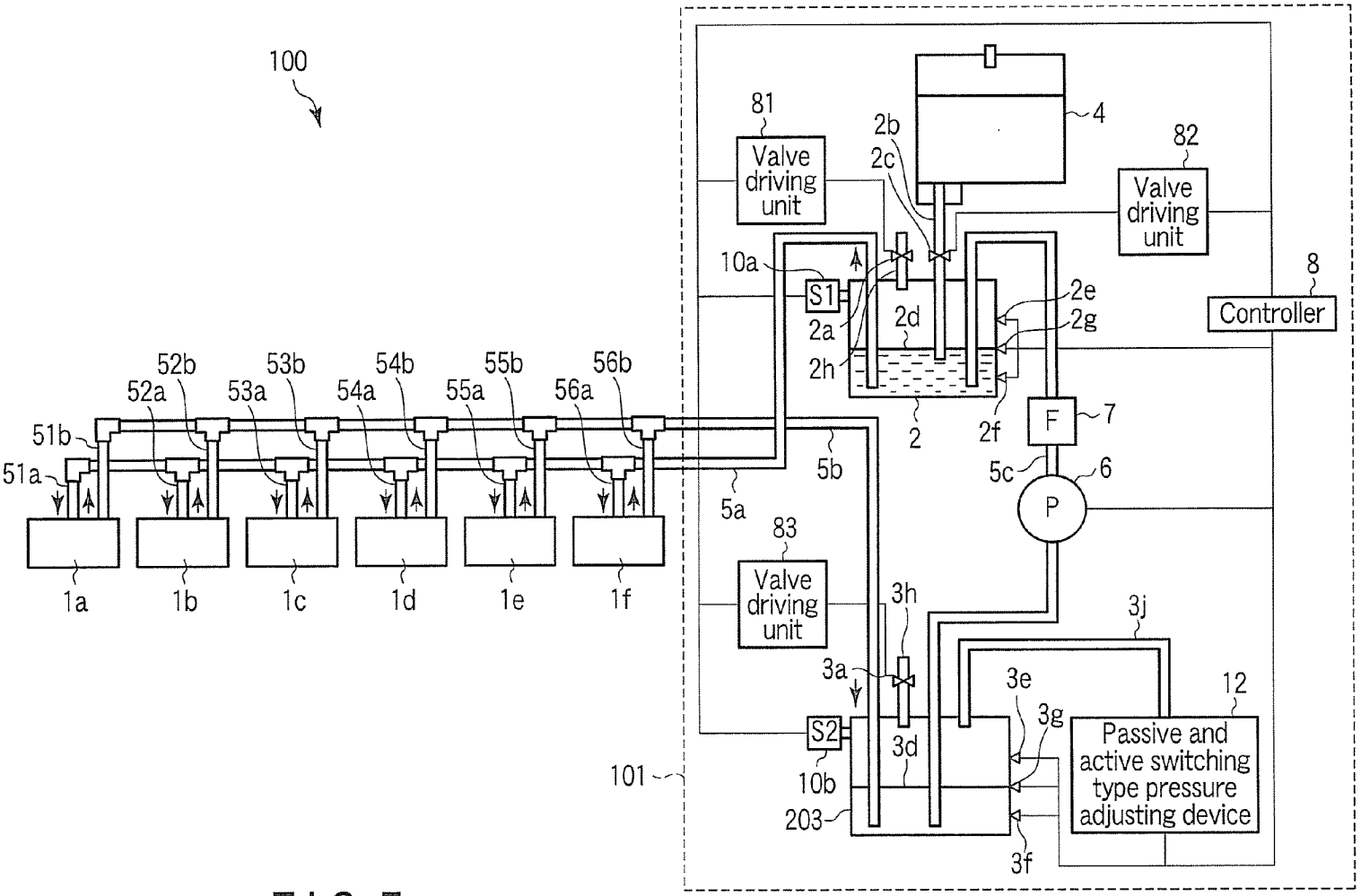
FIG. 7 is an exemplary schematic diagram for explaining an ink jet recording apparatus according to a second embodiment.

The ink jet recording apparatus 100 according to a second embodiment is explained below. FIG. 7 is a diagram of the configuration of the ink jet recording apparatus 100 according to the second embodiment. The ink jet recording apparatus 100 shown in FIG. 7 includes a passive and active switching type pressure adjusting device 12 instead of the passive pressure adjusting device 9 and the active pressure adjusting device 11 explained in the first embodiment. The passive and active switching type pressure adjusting device 12 is connected to the second tank 3 by a pipe 3*j*. The passive and active switching type pressure adjusting device 12 includes, as an integrated unit, the function of the passive pressure adjusting device 9 and the function of the active pressure adjusting device 11. The passive and active switching type pressure adjusting device 12 can switch, under the control by the controller 8, the ink jet recording apparatus 100 to operation of passive pressure adjustment or operation of active pressure adjustment under the control by the controller 8.

Figure 8:
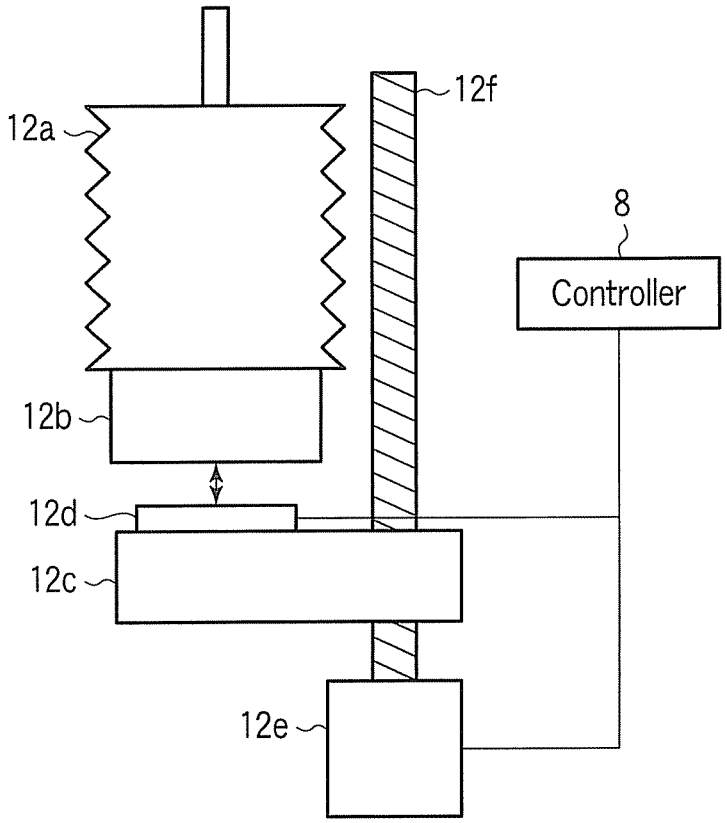
FIG. 8 is an exemplary diagram of the configuration of a passive and active switching type pressure adjusting device in the second embodiment.

FIG. 8 is a diagram of the configuration of the passive and active switching type pressure adjusting device 12. The passive and active switching type pressure adjusting device 12 includes bellows 12*a*, a weight 12*b*, a moving table 12*c*, an electromagnet 12*d*, and a motor 12*e*. The bellows 12*a* include the weight 12*b* in a lower part thereof. The moving table 12*c* is moved up and down in the vertical direction by the motor 12*e* via a shaft 12*f*. The electromagnet 12*d* is provided in the moving table 12*c*. The electromagnet 12*d* can switch joining to and separation from the weight 12*b* according to on and off of energization by the controller 8.

During normal circulation control, since the controller 8 turns off the energization to the electromagnet 12*d*, the electromagnet 12*d* is separated from the weight 12*b*. The passive and active switching type pressure adjusting device 12 applies negative pressure for the normal circulation control to the second tank 3 using the own weight of the weight 12*b*. In other words, the passive and active switching type pressure adjusting device 12 actuates a function of passive pressure adjustment. During high flow rate circulation control, since the controller 8 turns on the energization to the electromagnet 12*d*, the electromagnet 12*d* is joined to the weight 12*b*. The moving table 12*c* is moved up and down under the control by the controller 8 to move the bellows 12*a* up and down. Therefore, the passive and active switching type pressure adjusting device 12 performs pressure adjustment on the inside of the second tank 3. In other words, the passive and active switching type pressure adjusting device 12 actuates a function of active pressure adjustment.

High flow rate circulation control in a third embodiment is explained below. In the first embodiment, during the high flow rate circulation control, the ink jet recording apparatus 100 actuates the active pressure adjusting device 11. In the second embodiment, the ink jet recording apparatus 100 actuates the function of the active pressure adjustment of the passive and active switching type pressure adjusting device 12. However, embodiments are not limited to this. During the high flow rate circulation control, the active pressure adjusting device 11 does not have to be operating, the function of the active pressure adjustment of the passive and active switching type pressure adjusting device 12 does not have to be operating, or the ink jet recording apparatus 100 does not have to include the active pressure adjusting device 11. In other words, during the high flow rate circulation control, the controller 8 does not have to actively adjust the pressure on the inside of the second tank 3.

Figure 9:
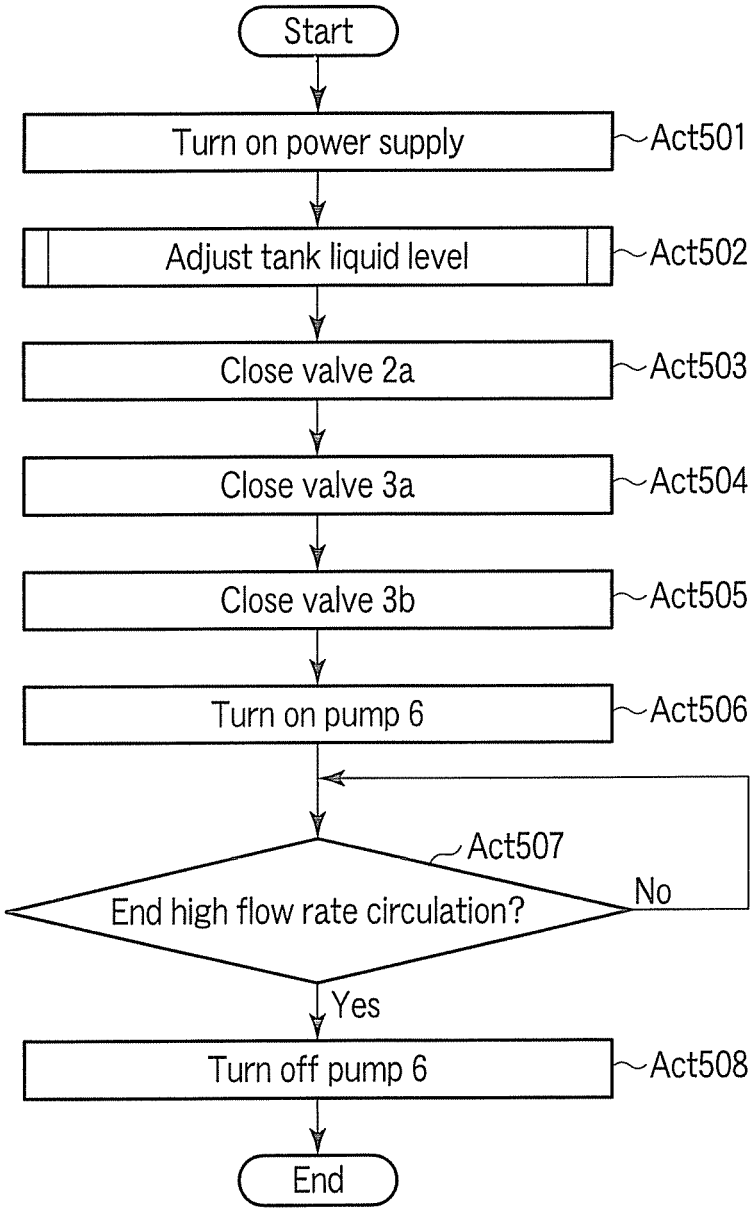
FIG. 9 is an exemplary flowchart for explaining high flow rate circulation control for ink in the third embodiment.

FIG. 9 is a flowchart for explaining the high flow rate circulation control for ink in the ink jet recording apparatus 100 according to the third embodiment. Acts 501 to 506 are respectively the same as Acts 301 to 306. Acts 507 and 508 are respectively the same as Acts 309 and 310. In the third embodiment, in Act 506, if the controller 8 turns on the operation of the pump 6 in order to move the ink stored by the second tank 3 to the first tank 2, in the first tank 2, since an amount of ink increases and the air layer is compressed, positive pressure is generated. Conversely, in the second tank 3, since an amount of ink decreases and the air layer is decompressed, negative pressure is generated. A pressure difference occurs between the first tank 2 and the second tank 3. Therefore, the ink stored by the first tank 2 moves in order through the common supply pipe 5*a*, the ink jet heads 1*a* to 1*f*, the common collection pipe 5*b*, and the second tank 3.

The controller 8 may perform control to start the high flow rate circulation control, for example, after detecting that the liquid level 2*d* of the first tank 2 is in the position of the liquid level sensor 2*g* and the liquid level 3*d* of the second tank 3 is in the position of the liquid level sensor 3*g* to detect that the volumes of the air layers of the first tank 2 and the second tank 3 are a fixed value. In this case, the controller 8 can manage the pressures on the inside of the first tank 2 and the second tank 3 to a proper value. If the pressures on the inside of the first tank 2 and the second tank 3 are kept at the proper value, the ink jet heads 1*a* to 1*f* do not cause ink leakage from the nozzles or suction of the air from the nozzles.

Figure 10:
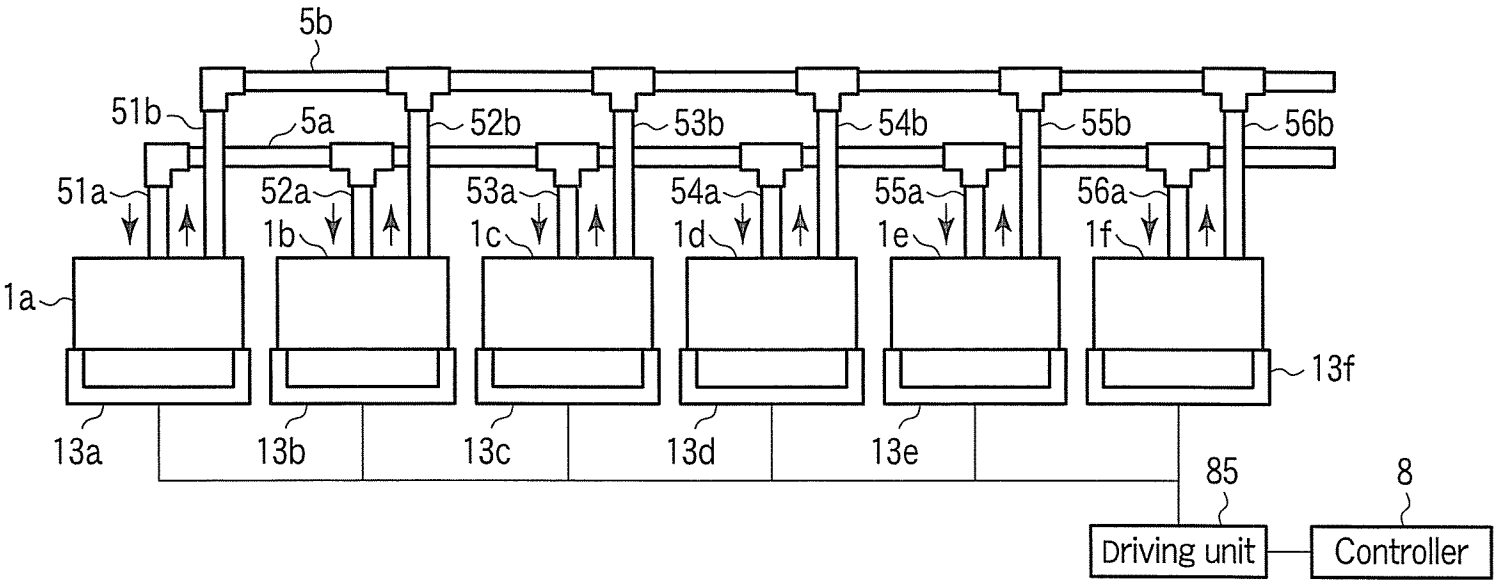
FIG. 10 is an exemplary schematic diagram of caps in a third embodiment.

In the third embodiment, as shown in FIG. 10, the ink jet recording apparatus 100 may include caps 13*a* to 13*f*. Before starting the high flow rate circulation control, the controller 8 performs control to seal the nozzles of the ink jet heads 1*a* to 1*f* respectively with the caps 13*a* to 13*f* via a driving unit 85. Thereafter, the controller 8 starts the high flow rate circulation control. The nozzles of the ink jet heads 1*a* to 1*f* do not suck the air during the high flow rate circulation control. Therefore, the controller 8 does not have to manage the pressures on the inside of the first tank 2 and the second tank 3.

Figure 11:
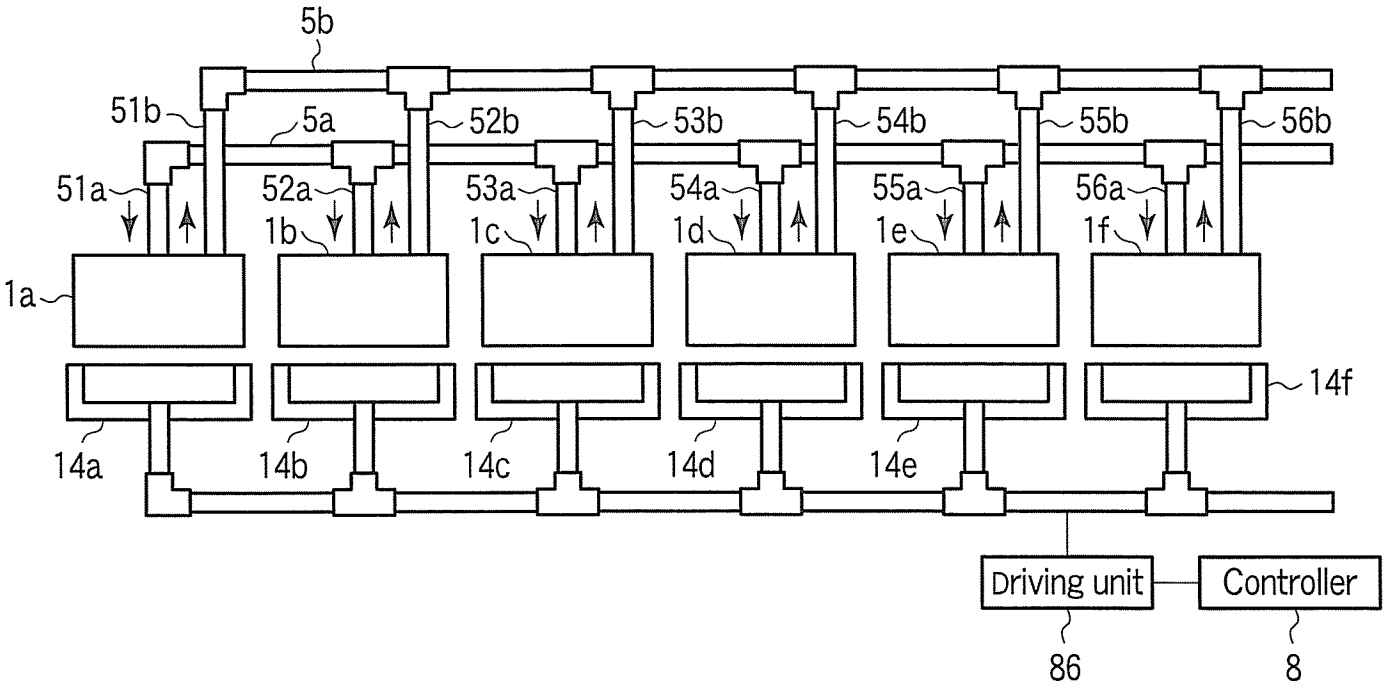
FIG. 11 is an exemplary schematic diagram of discharge devices in the third embodiment.

In the third embodiment, as shown in FIG. 11, the ink jet recording apparatus 100 may include discharge devices 14*a* to 14*f* together with the caps 13*a* to 13*f* or instead of the caps 13*a* to 13*f*. Before starting the high flow rate circulation control, the controller 8 performs control to move the discharge devices 14*a* to 14*f* to lower positions respectively opposed to the nozzles of the ink jet heads 1*a* to 1*f* via a driving unit 86. Further, the controller 8 performs control to change the pressure near the nozzles of the ink jet heads 1*a* to 1*f* to positive pressure. Thereafter, the controller 8 starts the high flow rate circulation control. In the ink jet heads 1*a* to 1*f*, it is likely that the ink overflows from the nozzles during the high flow rate circulation control. However, the discharge devices 14*a* to 14*f* can receive the ink. The ink received by the discharge devices 14*a* to 14*f* may flow out to a not-shown storage section connected to the discharge devices 14*a* to 14*f*.

According to this embodiment, the controller 8 can switch circulation control to the normal circulation control or the high flow rate circulation control and circulate the ink on the inside of the ink jet heads 1*a* to 1*f*. Therefore, the ink jet recording apparatus 100 can more effectively remove foreign matters near the nozzles of the ink jet heads 1*a* to 1*f* during the high flow rate circulation control than during the normal circulation control.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet recording apparatus comprising:

an ink jet head;

a first tank arranged above the ink jet head and configured to store ink to be supplied to the ink jet head;

a first tank valve that opens and closes in order to switch an inside of the first tank to be opened to or shut off from atmosphere;

a second tank arranged below the ink jet head and configured to store the ink collected from the ink jet head;

a second tank valve that opens and closes in order to switch an inside of the second tank to be opened to or shut off from the atmosphere;

a pipe configured to connect the ink jet head, the first tank, and the second tank and form a part of a circulation shape; a pump provided in the pipe between the first tank and the second tank;

a passive pressure adjusting device connected to the second tank and configured to generate negative pressure using gravity; and a third tank valve provided between the second tank and the passive pressure adjusting device; and a controller configured to perform control to circulate the ink stored in the first tank to the second tank via the ink jet head, wherein the controller performs control to switch circulation control to first circulation control and second circulation control for circulating the ink at a flow rate higher than that in the first circulation control and circulate the ink, wherein the controller performs control to close the first tank valve and the second tank valve, if the controller performs control in the second circulation control.

2. The apparatus of claim 1, wherein the controller performs control to start operation of the pump, if the controller performs control in the second circulation control.

3. The apparatus of claim 2, wherein, during the second circulation control, the controller performs control to shut off operation of the passive pressure adjusting device.

4. The apparatus of claim 3, further comprising an active pressure adjusting device configured to actively adjust pressure on the inside of the second tank.

5. The apparatus of claim 4, further comprising:

a first pressure sensor configured to detect pressure on the inside of the first tank; and a second pressure sensor configured to detect the pressure on the inside of the second tank, wherein control, the controller controls the operation of the active pressure adjusting device on the basis of detection information from the first pressure sensor and the second pressure sensor, during the second circulation control.

6. The apparatus of claim 3, further comprising:

an ink cartridge; and a fourth pipe configured to connect the ink cartridge and the first tank, wherein the controller performs control to adjust an amount of ink stored by the first tank and an amount of ink stored by the second tank before starting the second circulation control.

7. The apparatus of claim 3, wherein, during the second circulation control, the controller performs control to inhibit a printing operation.

8. The apparatus of claim 3, further comprising a cover configured to seal a nozzle of the ink jet head, wherein the controller performs control to seal the nozzle of the ink jet head with the cover before starting the second circulation control.

9. The apparatus of claim 3, further comprising a discharge section configured to receive the ink overflowing from a nozzle of the ink jet head, wherein the controller performs control to move the discharge section to a lower position opposed to the nozzle of the ink jet head before starting the second circulation control.

10. The apparatus of claim 1, wherein the pump is provided in the pipe between the first tank and the second tank not via the ink jet head.

11. An ink circulating method in an ink jet recording apparatus including:

a first tank arranged above an ink jet head and configured to store ink to be supplied to the ink jet head; a first tank valve related to the first tank; a second tank arranged below the ink jet head and configured to store the ink collected from the ink jet head;

a second tank valve related to the second tank; a pump provided in a pipe between the first tank and the second tank; and a passive pressure adjusting device connected to the second tank and configured to generate negative pressure using the gravity, the method comprising:

switching circulation control to first circulation control for circulating the ink stored in the first tank to the second tank via the ink jet head and second circulation control for circulating the ink at a flow rate higher than that in the first circulation control and circulating the ink; and closing the first tank valve and the second tank valve during the second circulation control.

12. The method of claim 11, further comprising starting operation of the pump during the second circulation control.

13. The method of claim 12, further comprising passively shutting off adjustment of pressure on an inside of the second tank during the second circulation control.

14. The method of claim 13, further comprising:

detecting pressure on an inside of the first tank; and detecting the pressure on the inside of the second tank.

15. The method of claim 14, further comprising controlling, during the second circulation control, the pressure on the inside of the second tank on the basis of detection information of the detection.

* * * * *